US007273079B2

(12) United States Patent
Kok

(10) Patent No.: US 7,273,079 B2
(45) Date of Patent: Sep. 25, 2007

(54) ELECTRIC PENCIL SHARPENER

(75) Inventor: Tsz Bun Kok, Hunghom (HK)

(73) Assignee: Progressive Plastic Metal Stationery Products Manufactory Limited, Hunghom, Kowloon, Hong Kong (CN)

( * ) Notice: Subject to any disclaimer, the term of this patent is extended or adjusted under 35 U.S.C. 154(b) by 0 days.

(21) Appl. No.: 11/340,569

(22) Filed: Jan. 27, 2006

(65) Prior Publication Data

US 2006/0151062 A1 Jul. 13, 2006

Related U.S. Application Data

(63) Continuation-in-part of application No. 11/033,898, filed on Jan. 13, 2005, now abandoned.

(51) Int. Cl.
*B43L 23/00* (2006.01)
*B43L 23/02* (2006.01)

(52) U.S. Cl. ..... 144/28.5; 144/28.6; 144/28.72

(58) Field of Classification Search ..... 30/451–462, 30/558; 144/28.5, 28.6, 28.72, 28.1, 28.4, 144/28.7, 28.8, 28.9, 28.2, 28.3; D19/73, D19/74, 75, 95, 99, 100
See application file for complete search history.

(56) References Cited

U.S. PATENT DOCUMENTS 2,561,438 A * 7/1951 Duchesneau ..... 144/28.5
2,822,781 A * 2/1958 Burton ..... 144/28.5
3,134,365 A 5/1964 Hori
3,486,540 A 12/1969 Hori
3,650,308 A 3/1972 Hori
3,678,975 A * 7/1972 Imanishi et al. ..... 144/28.5
3,746,061 A * 7/1973 Nakazaki ..... 144/28.5
3,777,791 A 12/1973 Uchida
4,050,487 A * 9/1977 Mabuchi et al. ..... 144/28.5
4,601,316 A 7/1986 Verdi
4,815,507 A 3/1989 O'Rourke
5,052,453 A 10/1991 Chen
5,161,587 A 11/1992 Wu
6,249,981 B1 6/2001 Shu
7,134,461 B2 * 11/2006 Takada ..... 144/28.72
2004/0016476 A1 * 1/2004 Lamers et al. ..... 144/28.6
2006/0086416 A1 * 4/2006 Takada ..... 144/28.72

* cited by examiner

*Primary Examiner*—Boyer D. Ashley
*Assistant Examiner*—Ghassem Alie
(74) *Attorney, Agent, or Firm*—Leydig, Voit & Mayer, Ltd.

(57) ABSTRACT

An electric sharpener has a casing, an electric motor, and a flat cutting blade for turning by the motor. There is an aperture in the casing through which a pencil can be inserted for sharpening by the cutting blade. An activation sensor is included for detecting when a pencil has been inserted through the aperture to close the electrical circuit, and a deactivation sensor for detecting a sharpened tip of the pencil to open the electrical circuit, thereby stopping the motor. The deactivation sensor has an actuating part for engagement and movement by the tip and a contact part supported by the actuating part for concurrent movement to break electrical contact with a fixed contact in the electrical circuit.

11 Claims, 5 Drawing Sheets

ELECTRIC PENCIL SHARPENER

The present invention relates to an electric pencil sharpener. More particulary, but not exclusively, the invention relates to an electric pencil sharpener having an automatic shut-off feature.

BACKGROUND OF THE INVENTION

Electric pencil sharpeners are known. These typically incorporate an electric motor driving a cutting implement such as a blade and a sensor to detect the presence of a pencil adjacent to the blade. When the sensor detects the presence of a pencil, the motor is activated to turn the blade and thereby sharpen the pencil. A problem with such known pencil sharpeners is that it is not known precisely when the pencil is sufficiently sharpened and therefore the motor keeps turning and the pencil is cut unnecessarily short, resulting in waste of pencil material.

OBJECT OF THE INVENTION

It is the object of the present invention to overcome or substantially ameliorate the above disadvantage and/or more generally to provide an improved electric pencil sharpener having an automatic shut-off device that detects when the pencil is sufficiently sharpened and terminating the sharpening operation.

SUMMARY OF THE INVENTION

According to the invention, there is provided an electric sharpener comprising a casing, an electric motor with an associated electrical circuit located in the casing, and a cutter arranged to be turned by the motor. There is an aperture in the casing through which a pencil can be inserted for sharpening by the cutter. A first sensor is included for detecting when said pencil has been inserted through the aperture to close the electrical circuit, and so is a second sensor for detecting a sharpened tip of said pencil to open the electrical circuit. The second sensor comprises an actuating part for engagement and movement by said tip and a contact part supported by the actuating part for concurrent movement to break electrical contact from a contact.

Preferably, the contact part is movable along a linear path in opposite directions.

Preferably, the contact part is carried by the actuating part.

More preferably, the contact part includes a flange for electrical contact with said contact.

Further more preferably, the contact part comprises a cap having the flange and is located partially within a recess fixed to the actuating part.

It is further preferred that the actuating part has a tubular end as the recess partially within which the cap is located.

It is further preferred that the cap is resiliently held partially within the recess by a spring.

Yet further more preferably, the actuating part is resiliently biased by the spring for engagement by said tip to move against the action of the spring.

In a preferred embodiment, the contact is elongate, having one end for contact by the contact part and an opposite end connected to the electrical circuit.

More preferably, the contact lies on an internal support of the casing.

In a preferred embodiment, the second sensor includes two said contacts for simultaneous contact by the contact part.

It is preferred that the cutter comprises a flat cutting blade.

It is further preferred that the actuating part includes a slot into which the blade extends.

Preferably, the electric pencil sharpener includes a spring biasing the actuating part in a direction towards the aperture.

BRIEF DESCRIPTION OF DRAWINGS

The invention will now be described, by way of example only, with reference to the accompanying drawings, in which.

DETAILED DESCRIPTION OF PREFERRED EMBODIMENT

Figure 1:
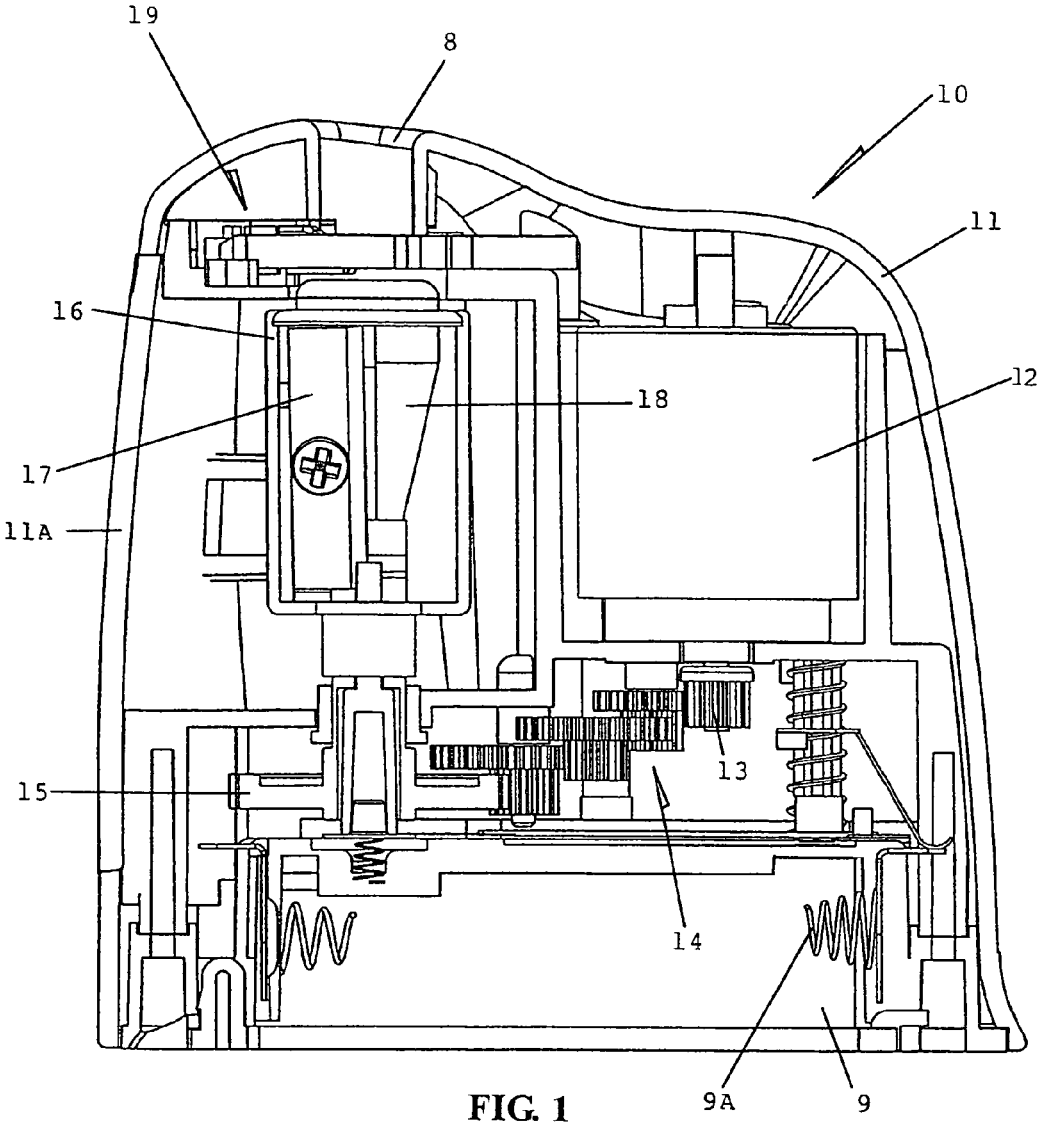
FIG. 1 is a cross-sectional side view of an embodiment of an electric pencil sharpener in accordance with the invention.
Figure 2:
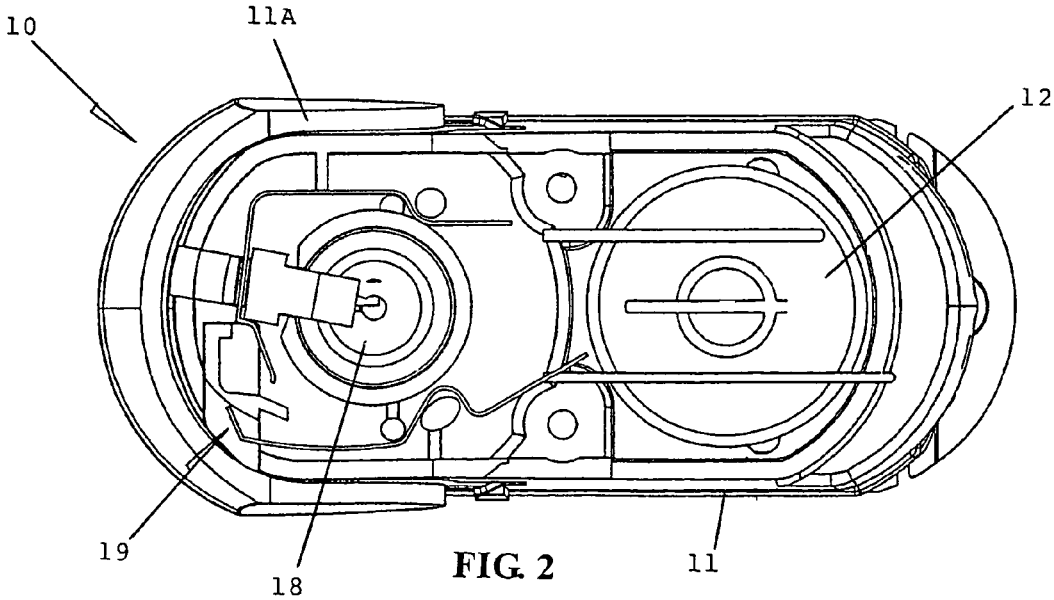
FIG. 2 is an internal bottom plan view of the pencil sharpener of FIG. 1.
Figure 3:
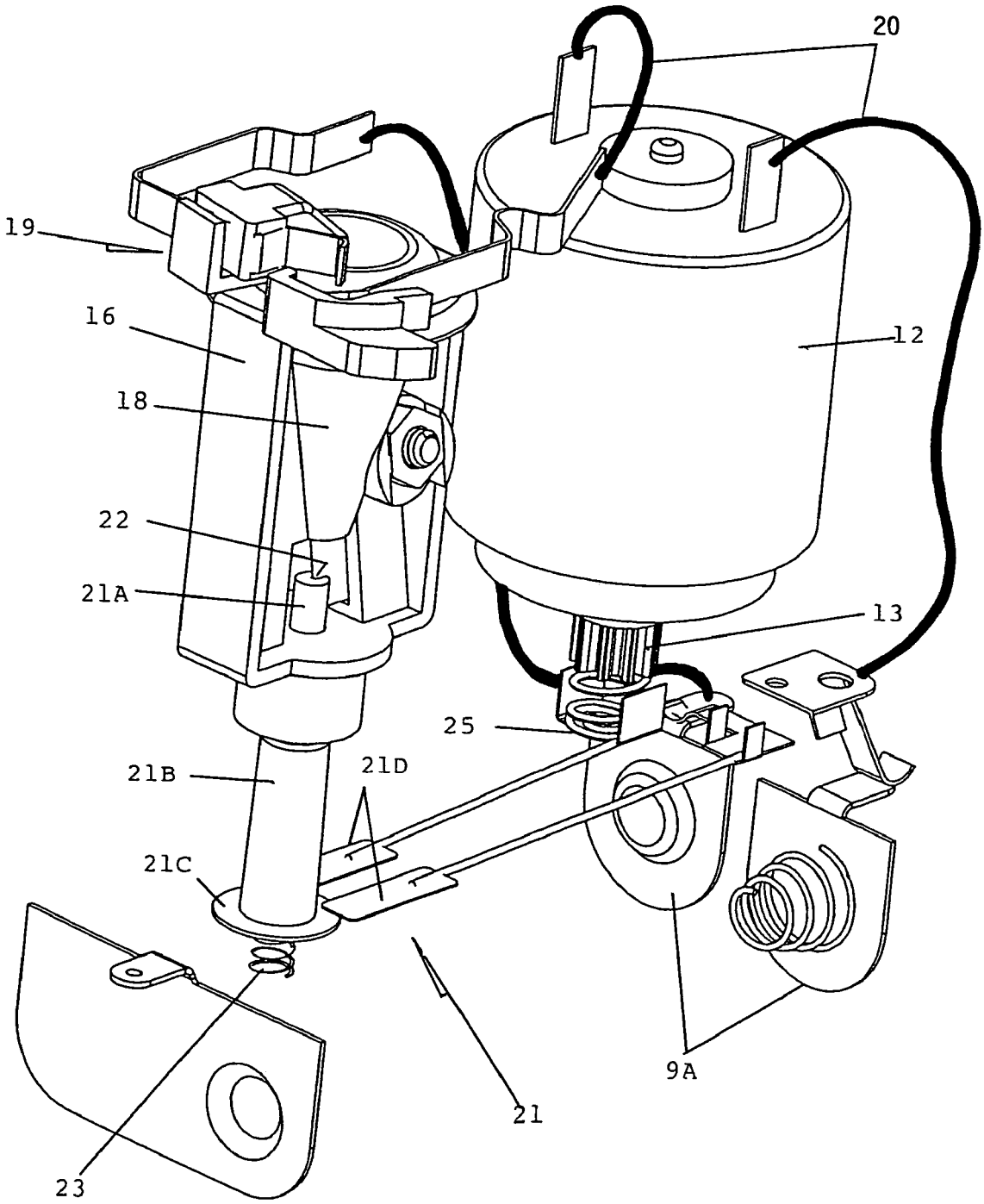
FIG. 3 is a top perspective view of an internal operating mechanism of the pencil sharpener of FIG. 1.
Figure 4:
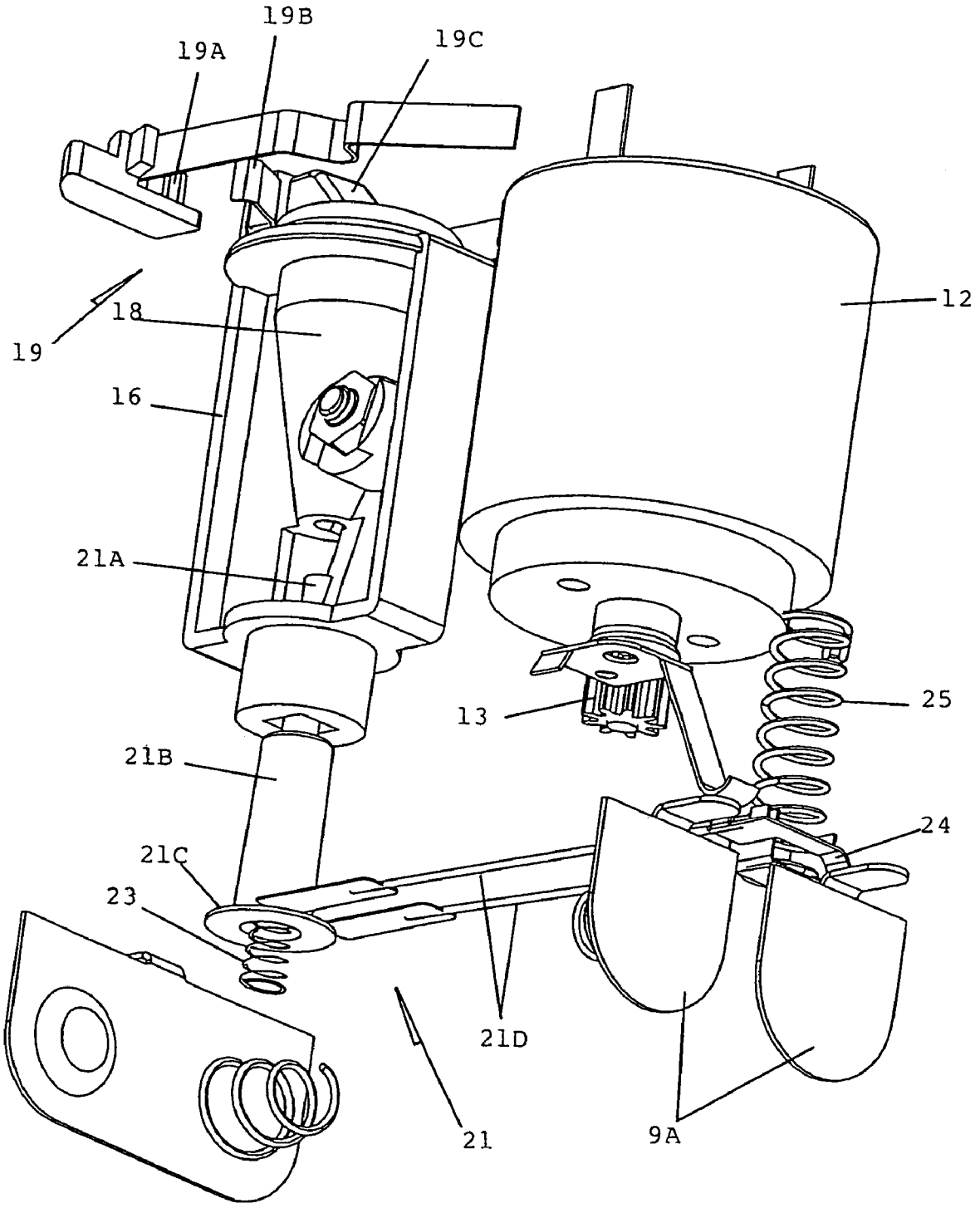
FIG. 4 is a bottom perspective view of the operating mechanism of FIG. 3.
Figure 5:
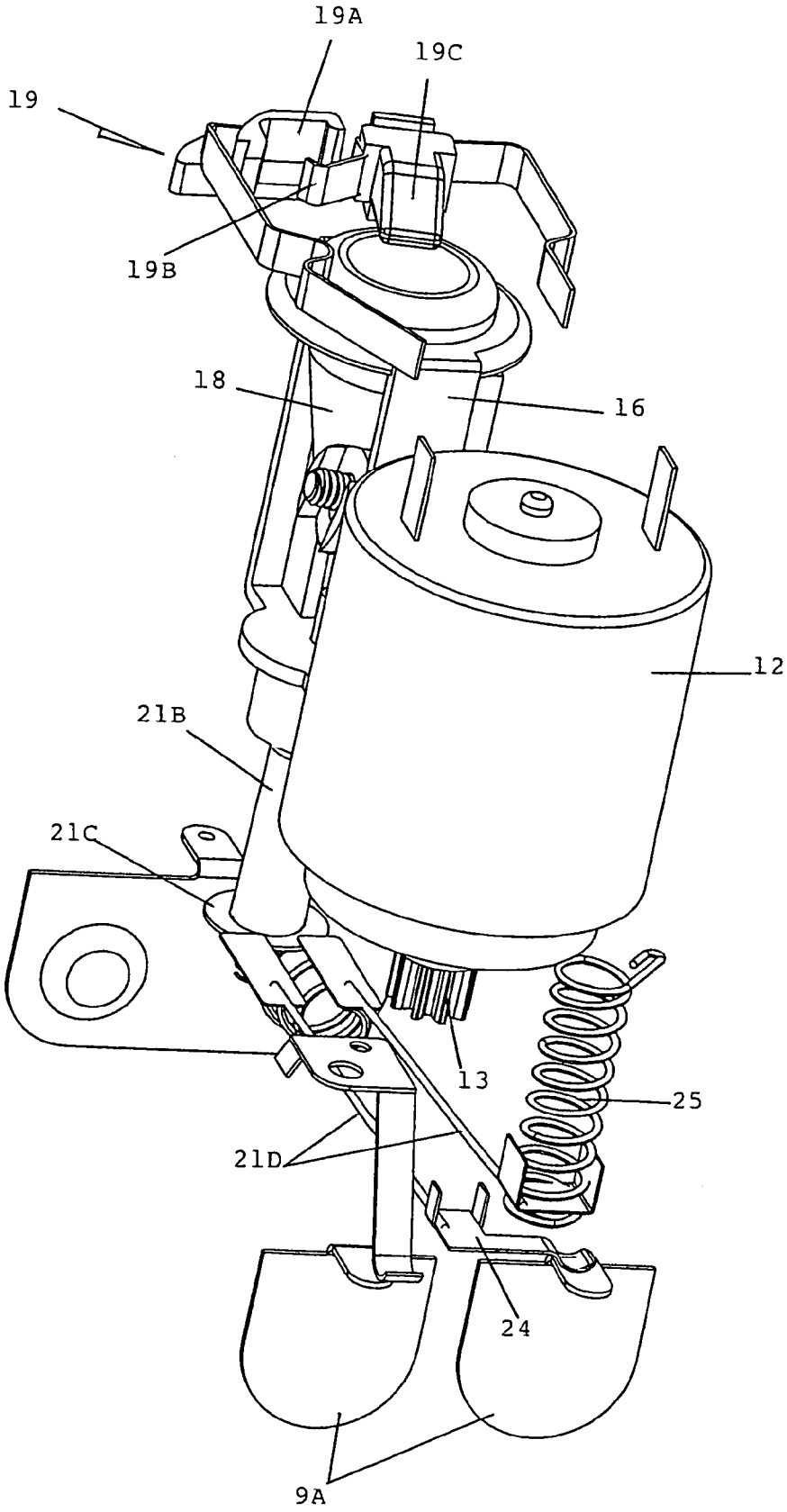
FIG. 5 is another top perspective view of the operating mechanism of FIG. 3.

Referring to the drawings, there is shown an electric pencil sharpener 10 embodying the invention, which has a casing 11 including a battery compartment 9 at its bottom for holding two AA battery cells. Located within the casing 11 are an electric motor 12 having an output pinion 13 in drive engagement with a gear train 14 and an electrical circuit 20 which connects the motor 12 to a pair of positive and negative terminals 9A of the battery compartment 9.

The gear train 14 has an end gear 15 engaging a rotatable body 16 which has a cutter in the form of a flat cutting blade 17 affixed thereto. The rotatable body 16 has an inverted conical cavity 18 for receiving the front end or tip of a pencil, tangentially into which the cutting blade 17 extends.

The top of the casing 11 has an aperture 8 which is aligned co-axially with the conical cavity 18 vertically below. A pencil can be inserted downwardly with its tip through the aperture 8 into the casing 11 to be received within and bearing against the cavity 18 for sharpening by the cutting blade 17 that turns with the body 16 upon rotation.

In order to cause rotation of the sharpening body 16, the motor 12 must first be activated. To this end, there is provided an activation sensor 19 within the aperture 8 to detect when a pencil has been inserted through the aperture 8 before turning on the motor 12. The sensor 19 is effectively a normally-open electrical switch formed by a fixed contact 19A and a moving contact strip 19B co-operating therewith, both being part of the electrical circuit 20 connected in series therein. The contact strip 19B is connected with a knob 19C which protrudes from one side slightly into the aperture 8 such that as a pencil is inserted through the aperture 8, the pencil presses the knob 19C to push the contact strip 19B into contact with the fixed contact 19A, thereby closing the switch 19 to complete the electrical circuit 20.

The electrical circuit 20 includes an automatic shut-off sensor 21 to open the circuit 20 in order to deactivate the motor 12 upon detection of the pencil having just been adequately sharpened by the cutting blade 17. The shut-off sensor 21 is formed by an actuating pushbutton 21A at a bottom apex of the conical cavity 18, an upright tube section 21B integrally connected below the pushbutton 21A, an electrically conductive contact cap 21C located partially within a recessed/tubular lower end of the tube section 21B, and a pair of horizontal elongate lever contacts 21D.

The pushbutton 21A passes upwardly through a lower end of the rotatable body 19 to reach the bottom apex of the conical cavity 18, and is guided for slight sliding movement upwards and downwards along a vertical linear path. The cap 21C has a body fitted within the lower end of the tube section 21B and an annular integral flange extending radially outwards from the tube 21B. A coil spring 23 acts from below against the body of the cap 21C to thereby keep the cap 21C engaged with the tube section 21B while simultaneously bias the pushbutton 21A upwards.

Figure 6A:
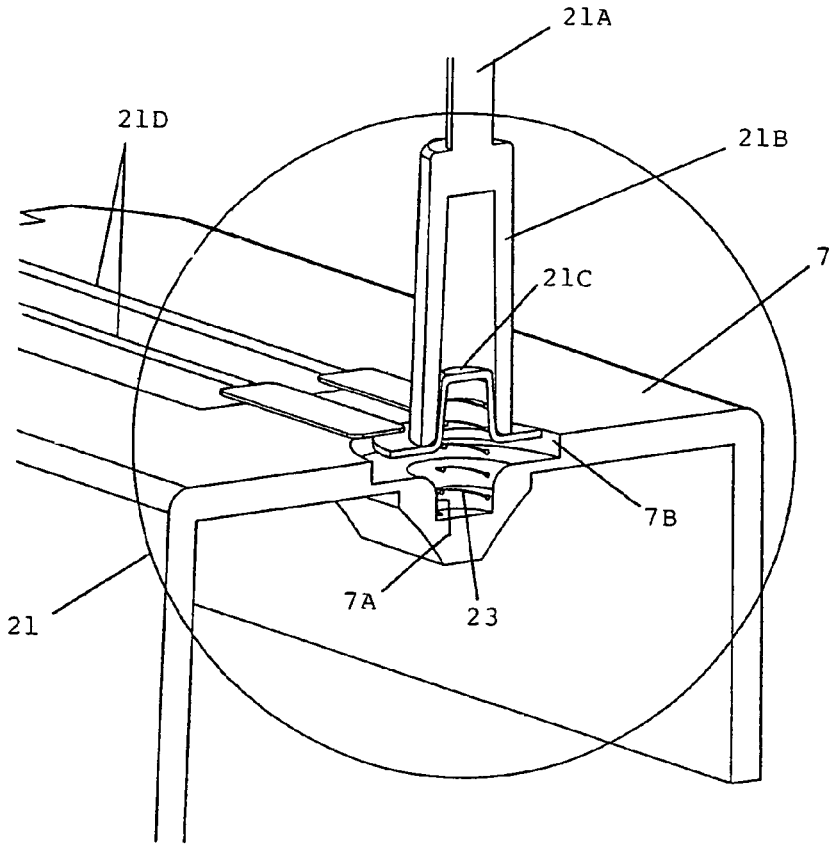
FIGS. 6A and 6B are fragmentary perspective views showing an automatic shut-off device of the pencil sharpener of FIG. 1, in different operating conditions.

An internal platform 7 of the casing 11 has a cylindrical recess 7A that supports the lower end of the spring 23, and the recess 7A has a widened flat upper end 7B that accommodates the flange of the cap 21C. The two lever contacts 21D lie side-by-side on the platform 7, each of which has an enlarged flat front end protruding laterally over the upper recess end 7B and in contact by the flange of the cap 21C as the cap 21C normally stays upwards under the action of the spring 23 (FIG. 6A).

One lever contact 21D is connected at its rear end by a contact leaf 24 to the positive terminal 9A of the battery compartment 9, whilst the rear end of the other lever contact 21D is connected via a conducting coil spring 25 to another part of the electrical circuit 20. The two lever contacts 21D serve like as a pair of fixed contacts for short-circuiting by the cap 21C that operates as a moving contact, together constituting a normally-closed switch connected in series in the electrical circuit 20.

The pushbutton 21A includes a vertical/longitudinal V-shaped slot 22 into which the lowermost portion of the sharp cutting edge of the blade 17 is located. This lowermost portion of the cutting edge extends to the center of the pushbutton 21A, or close proximity thereof, for producing a suitably sharp graphite tip at the frontmost end of the pencil.

Figure 6B:
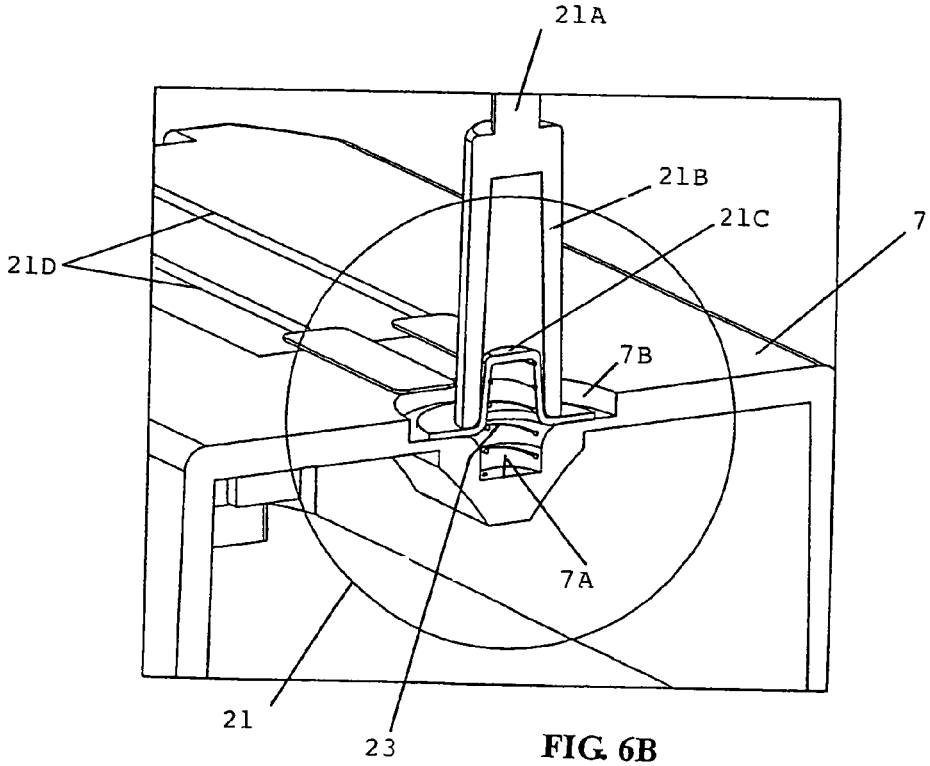

The sharp graphite tip will, during formation, extend to and thus press upon the pushbutton 21A against the action of the spring 23, thereby pushing the tube section 21B and hence the cap 21C downwardly. Immediately upon lowering of the cap 21C from the front ends of the lever contacts 21D (FIG. 6B), the shut-off sensor 21 switches open to break the electrical circuit 20. As a result the motor 12 stops and the sharpening operation terminates.

The graphite of a blunt or broken pencil will not reach the pushbutton 21A, but once the pencil is adequately sharpened, its graphite tip will extend down to press the pushbutton 21A to thereby bring about the automatic shut-off function.

The cap 21C is wholly supported and/or carried by the pushbutton 21A, via the tube section 21B that is integrally connected to or an integral part of the pushbutton 21A. As the cap 21C is integrated with the pushbutton 21A, it will be directly moved by and concurrently move with the pushbutton 21A in unison, without or with minimum fear of mechanical delay and intervention. This permits the making of an effective and reliable switch for sensing the formation of an adequately sharpened pencil tip.

The casing 11 has a snap-on side cover 11A about the rotatable body 16, which can be detached to enable disposal of pencil shavings accumulated about the body 16.

The invention has been given by way of example only, and various modifications of and/or alterations to the described embodiment may be made by persons skilled in the art without departing from the scope of the invention as specified in the appended claims.

What is claimed is:

1. An electric pencil sharpener comprising:

a casing;

an electric motor;

an electrical circuit located in the casing for supplying an electrical current to the electric motor, the electrical circuit including a moveable contact for opening the electrical circuit;

a cutter turned by the motor;

an aperture in the casing through which a pencil can be inserted for sharpening by the cutter;

a first sensor closing the electrical circuit when the pencil has been inserted through the aperture; and a second sensor comprising an actuating part having a recess and a contact part, carried by the actuators part, the contact part including a cap having a flange for making electrical contact with the moveable contact, the cap being partially located within the recess, the second sensor opening the electrical circuit at the moveable contact in response to movement of the actuating part by a sharpened tip of the pencil.

2. The electric pencil sharpener as claimed in claim 1, wherein the contact part is movable along a linear path in opposite directions.

3. The electric pencil sharpener as claimed in claim 1, wherein the actuating part has a tubular end as the recess, partially within which the cap is located.

4. The electric pencil sharpener as claimed in claim 1, including a spring, wherein the cap is resiliently held partially within the recess by the spring.

5. The electric pencil sharpener as claimed in claim 4, wherein the actuating part is resiliently biased by the spring for engagement by the sharpened tip for movement against action of the spring.

6. The electric pencil sharpener as claimed in claim 1, wherein the moveable contact is elongate, has a first end for contact by the contact part, and a second end connected to the electrical circuit.

7. The electric pencil sharpener as claimed in claim 6, wherein the moveable contact is supported on an internal support of the casing.

8. The electric pencil sharpener as claimed in claim 1, wherein the moveable contact includes two lever contacts for simultaneous contact by the contact part.

9. The electric pencil sharpener as claimed in claim 1, wherein the cutter comprises a flat cutting blade.

10. The electric pencil sharpener as claimed in claim 9, wherein the actuating part includes a slot into which the blade extends.

11. The electric pencil sharpener as claimed in claim 1, including a spring biasing the actuating part in a direction towards the aperture.

* * * * *